United States Patent [19]

Petrusenko et al.

[11] 3,935,090

[45] Jan. 27, 1976

[54] COVERING OF AN ALUMINUM-PRODUCING ELECTROLYSIS CELL

[76] Inventors: Dmitry Pavlovich Petrusenko, ulitsa Degtyareva, 25, kv. 32; Lev Grigorievich Andreev, ulitsa Dzerzhinskogo, 22, kv. 12; Alexandr Mikhailovich Epshtein, prospekt Lenina, 22, kv. 77, all of Vologograd, U.S.S.R.

[22] Filed: Mar. 15, 1974

[21] Appl. No.: 451,603

[52] U.S. Cl. ..... 204/243 R

[51] Int. Cl.[2] ..... C25C 3/08; C25C 3/22

[58] Field of Search ..... 204/243 R–247

[56] References Cited

UNITED STATES PATENTS

| | | | |
|---|---|---|---|
| 3,351,546 | 11/1967 | Chambran et al. | 204/247 X |

FOREIGN PATENTS OR APPLICATIONS

| | | | |
|---|---|---|---|
| 251,834 | 5/1968 | U.S.S.R. | 204/247 |
| 269,494 | 5/1965 | U.S.S.R. | 204/247 |
| 276,438 | 5/1968 | U.S.S.R. | 204/247 |

*Primary Examiner*—John H. Mack
*Assistant Examiner*—Aaron Weisstuch
*Attorney, Agent, or Firm*—Haseltine, Lake & Waters

[57] ABSTRACT

The covering of an aluminium-producing electrolysis cell is made as a hood for gathering and extracting volatiles, mounted over the cell.

Provided at the edges of said hood are inclined lids interconnected with the levers of the drive shafts, as well as inclined guideways for said lids.

Each of said levers carries one of the arms of the double-arm angle hanger, said arm being arranged lengthwise said lever pivotally round the longitudinal axis thereof, while the other arm of said hanger is articulated to the top end face of the lid and with its loose end rests upon the adjacent lever.

Such a covering enables the electrolysis cell to be attended when its lids are partly raised which cuts down power consumption of the ventilation system and improves labour conditions of the attending personnel.

5 Claims, 5 Drawing Figures

COVERING OF AN ALUMINUM-PRODUCING ELECTROLYSIS CELL

This invention relates to coverings of aluminium-producing electrolysis cells used in metallurgical industry.

The herein-disclosed covering is suitable for use in electrolysis cells having multiple-block preburnt anodes applied in electrowinning of aluminum.

Known in the art is a covering of an aluminium-producing electrolysis cell, which is made as a hood mounted above the cell and adapted for gathering and eliminating volatiles, said hood featuring the edges of the side walls thereof arranged in parallel with the side walls of the cell and having inclined lids adjacent to said edges and resting with their top portion upon the hood stationary part and with their bottom portion, upon the beams along the cell side walls. To provide simultaneous opening of all the lids, the covering has air cylinders to actuate the beams with the lids to turn.

The lids are to be opened for the sake of cell maintenance, e.g., for electrolyte crust chopping, charging alumina and fluoric salts, cleaning the cathode bottom and some other operations. In performing some of such operations, e.g., anode replacement, discharge of metal into the ladle, piercing electrolyte crust for the gases to vent out, one of the cell lids is to be opened by hand. When all the lids are to be opened at a time, they are turned so that their bottom end gets at the level of their top end or above it. As a result, the cell gets very exposed and, in order to avoid gas escaping from under the covering into the shop's atmosphere, the power of the gas exhaust plants should be increased, which is of special importance in the case of the crust piercing procedure.

Besides, when attending the cell the operator remains in a dangerous condition under the cell lid, being thus exposed to the effects of gas and high temperature of convective and radiant heat.

Known in the art is one more covering of an aluminium-producing cell made as a hood mounted over the cell and adapted to gather and eliminate volatiles, wherein the edges of the walls are parallel to the cell walls and provision is made for inclined lids adjacent to said edge and to one another and interconnected with the levers of the drive shafts, said shafts being arranged along the longitudinal cell walls behind the holders of the block-type preburnt anodes.

With the covering closed the lids with their top portion adjoin the hood stationary part, and with the bottom portion, adjoin the gas exhaust duct.

To open the lids for the sake of cell maintenance operations, the covering is provided with lid raising mechanisms. In order to open the lids on one of the cell sides, one must turn the respective shaft with the levers with the result that the lids will turn above their horizontal position and render the cell exposed to a great extent. Since the gas exhaust outlet is in the bottom portion of the covering, so with the cell open, escapement of harmful substances into the shop's atmosphere is unavoidable and the operator performing manual operations of the cell attendance, must stay close to or under the overhanging lids, thus being subjected to the harmful effect of concentrated toxic substances and radiated heat, while the principal gas flow passes at the level of the operator's face.

A cardinal disadvantage inherent in said covering under said conditions resides in the potential danger to inflict injury upon the attending personnel in case of possible dropping of the covering lids.

During operating routine of the known coverings, the lids hanging over the cathode impede the introducing of the actuating member of the cell attending mechanism into the space in between the cathode unit of the cell and the lids raised thereabove. This refers equall to difficulties arising during operation of the coverings using the above-discussed way of opening the lids.

Small quantity of the known types of cell coverings does not allow said disadvantages to be obviated completely.

It is therefore a primary object of the present invention to provide a covering of an aluminium-producing electrolysis cell which would make it possible to perform cell maintenance operations with the lids partly raised.

It is another important object of the present invention to cut down power consumed by the gas exhaust system of the cell.

One more important object of the invention is to ensure normal environmental conditions within the zone of process maintenance of the cell when the covering lids are open.

It is still another objects of the present invention to eliminate the danger of injuring the attending personnel by the raised lids of the covering.

Said and other objects are attained by the provision of a covering of an aluminium-producing electrolysis cell having preburnt anodes, which is made as a hood located over the cell adapted to gather and eliminate volatiles, wherein the edges of the side walls are parallel to the side walls of the cell and provision is made for inclined lids adjacent to said edges and to one another and interconnected with the levers of the drive shafts located behind the anode holders wherein, according to the invention inclined guideways for the lids are provided at the edges of the hood side walls, each of said lids with its top end face being articulated to the respective lever through an angle hanger whose one arm is arranged along the lever and is articulated thereto, while the other arm carries the lid which is articulated thereto with its top end face and has a loose end with which it rests upon the adjacent lever.

Due to an articulated jointing of the lids to the angle hangers, when the levers are moved upwards the bottom portion of the lid is urged to deflect towards the covering space to establish a gap large enough for the actuating member of the cathode attending mechanism to pass. With such a constructional arrangement of the covering the lids do not hang over the operators attending the cell.

Besides, whenever necessary, each of the lids can be opened manually independently of the other lids by being turned in the articulated joints of the double-arm angle hanger with respect to one or both of the arms thereof.

Said construction of the covering provides for normal ambient air conditions for the cell attending personnel, protects the latter against the effect of heat irradiated by the cell and precludes any injuries to the operators by the raised lids.

Moreover, the covering is a packed structure and enables the use of highly efficient cell attending mechanisms.

It is expedient that the portions of the hood side walls that are adjacent to the hood edges be made as level platforms and that said shafts with the levers be located thereon.

Said platforms establish favourable conditions for safe attending of the contact units of the anode bar system.

It is desirable that a recess be made in the side level portions of the hood for the anode-holder rods to pass and that said recess be covered with metal plates having baffles adapted to close the spaces between the guideways and located at the same level therewith.

The spaces are necessary for the replacement of the cell anodes.

When the cell is operative said recesses are closed by the metal plates whose baffles close the free spaces between the adjacent lid guideways, thus making the covering airtight at the places of adjoining of the inclined lids to the hood level platforms.

Each of said metal plates covering the recesses may be held with one of its sides to the level platform through an articulated joint featuring a gap between its links permitting the plate to move longitudinally.

Such an articulated joint ensures the required plate movement for its baffle to come out of the gap between the lid guideways and its subsequent turn when exposing the recess.

It is not less expedient that each lid be provided with a shaped projection located on the side facing the guideway and provided with bevels made in the direction of the lid movement along a preset steep path.

The shaped projections provided on the lids ensure that the lid bottom edge moves in the zone of immersion into alumina melt along a steep path so as to prevent the effect of horizontal forces of resistance of alumina melt on the lid.

To illustrate the invention in detail given below are exemplary embodiments of a covering of an aluminium-producing electrolysis cell with due reference to the accompanying drawings, wherein.

Figure 1:
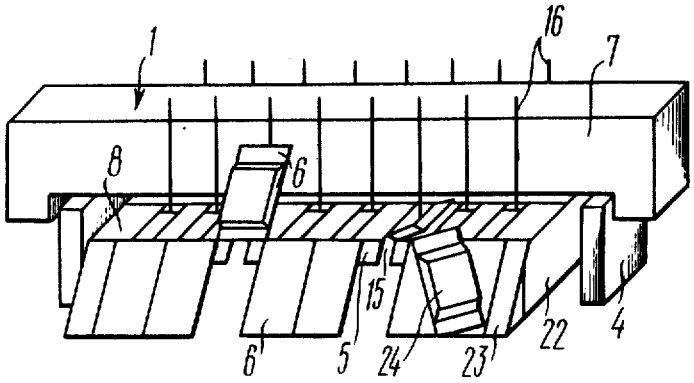
FIG. 1 illustrates a perspective view of a hood of an electrolysis cell covering, showing two open lids and one open metal plate with baffle.
Figure 2:
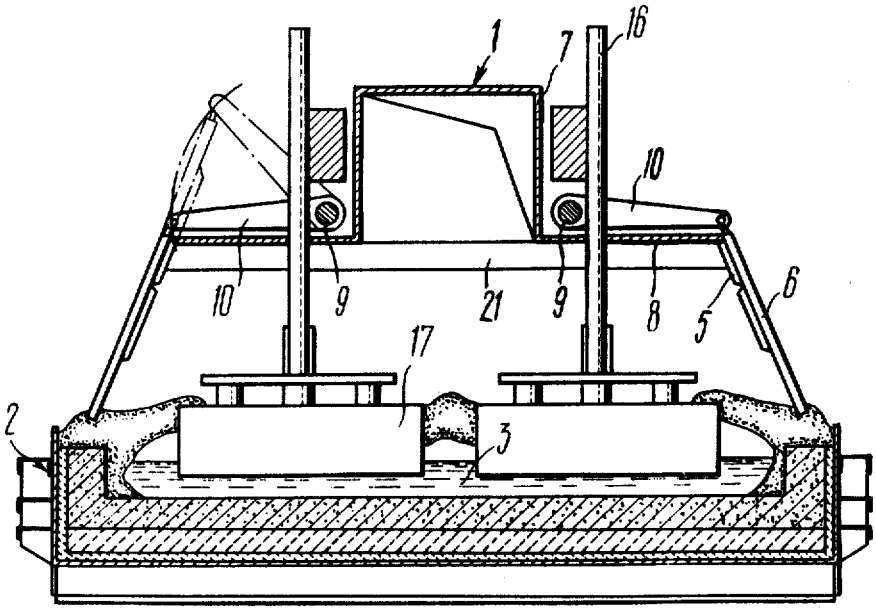
FIG. 2 illustrates a cross-sectional view of FIG. 1.

The covering of an aluminum-producing electrolysis cell is made as a metal hood 1 (FIG. 1) mounted over an electrolysis cell 2 (FIG. 2). The hood 1 is for gathering and removing the volatiles resulting from the process of electrolysis of an alumina melt 3. The hood 1 rests upon stands 4 (FIG. 1) provided on the end faces of the cell 2 (FIG. 2). The side walls of the hood 1 are parallel to the side walls of the cell 2 and carry inclined guideways 5 for lids 6. The middle portion of the hood 1 is made as a duct 7, while the side walls adjacent thereto are made as level platforms 8 mounting shafts 9 with levers 10.

Figure 3:
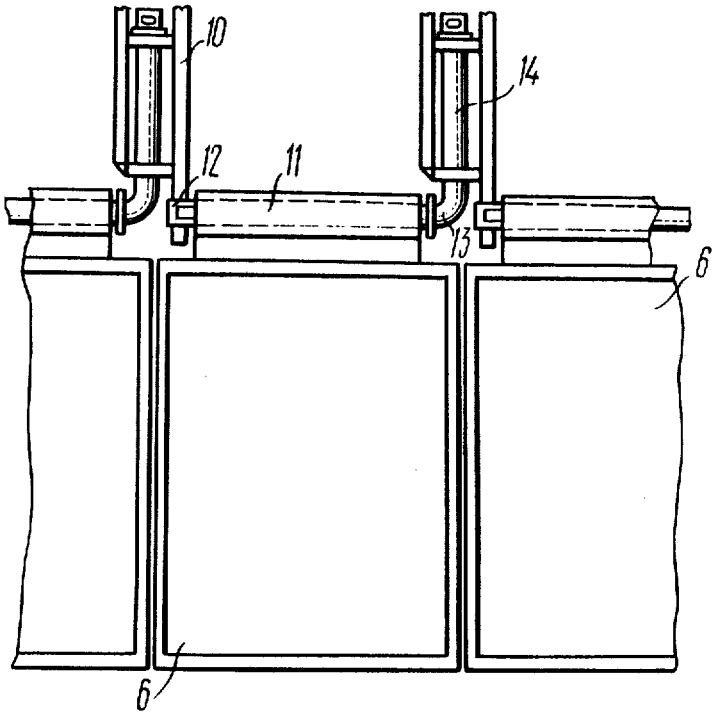
FIG. 3 illustrates lids with double-arm angle hangers and levers.
Figure 4:
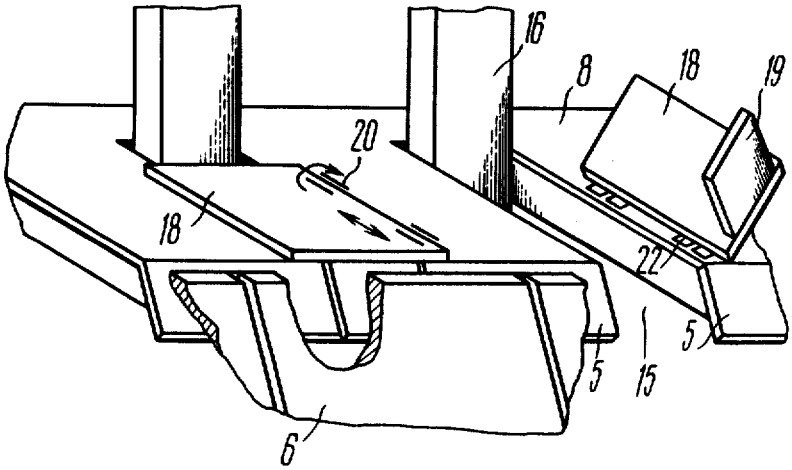
FIG. 4 illustrates a fragmentary view of a level platform with recesses, one of which is open and the other is closed by a metal plate with a baffle, a partially cutaway view of a lid and guideways for lids.

Each of the lids 6 (FIG. 3) has on its top end face a sleeve 11 fitted over one arm 12 of a duble-arm angle hanger 13, while its other arm 14 is arranged along the lever 10 and is mounted thereon pivotally round its longitudinal axis. The arm 12 carrying the lid 6, with its loose end rests upon the adjacent lever 10. The side level platforms 8 (FIG. 4) have recesses 15 for passing rods 16 of the holders of block-type preburnt anodes 17 (FIG. 2). The recesses 15 (FIG. 4) are covered by metal plates 18 with baffles 19 adapted to close the free spaces between the guideways 5 and located at the same level therewith. Each metal plate 18 with one of its sides is connected to the level platform 8 through articulated joints 20, a gap being provided in between the links of said joints for the plates 18 to move longitudinally. The level platforms 8 and the guideways 5 are held by cross beams 21 (FIG. 2) secured to the bottom of the duct 7.

The duct 7 is dimensioned so as to provide equal volatiles suction rate throughout the cell length and their expelling into the exhaust ventilation system (not shown in the drawing). Besides, the duct serves as a longitudinal load-bearing beam carrying all the components of the covering. The hood 1 has end walls 22 (FIG. 1).

Each of the lids 6 is located against the anode 17 (FIG. 2); besides, an extreme lid 23 (FIG. 1) is provided on each side of the hood.

Figure 5:
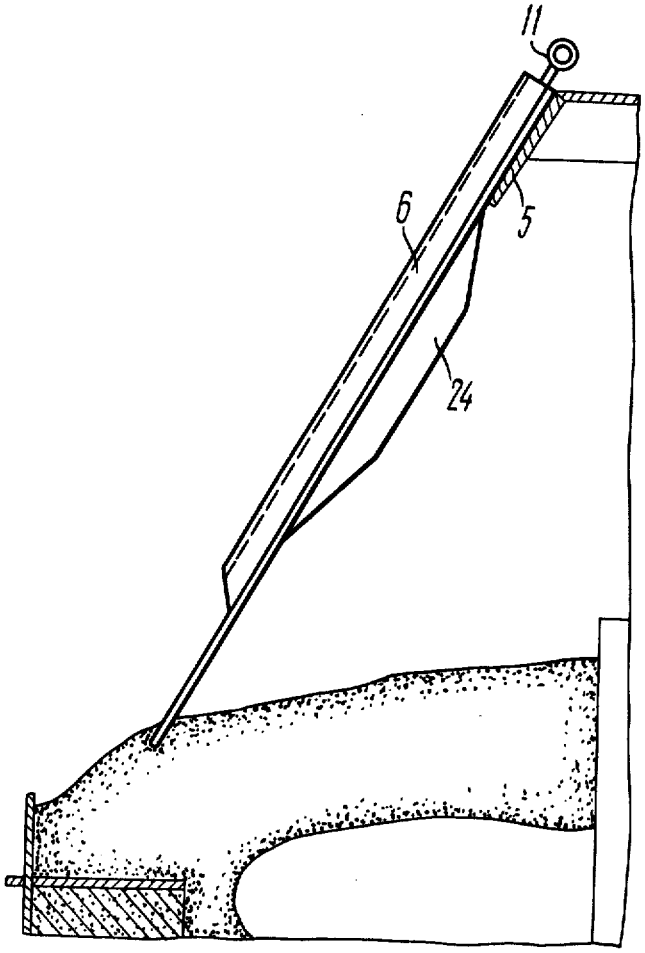
FIG. 5 illustrates a side view of a lid with a shaped projection.

All the lids 6 and 23 have on their side facing the guideways 5 (FIG. 5), shaped projections 24 with bevels made in the direction of the lid motion. The shaped projections 24 are adapted to ensure that the bottom edges of the lids 6 and 23 move along a preset steep path and to eliminate harmful effect of the horizontal resistance forces upon the lids 6 and 23 at the moment they are immersed into alumina melt.

The herein-disclosed covering functions as follows during the electrolysis cell operation.

When closed the covering features its lids 6 (FIG. 1) in the downward position. In case of maintenance operation of the cell, such as piercing the electrolyte crust, charging alumina or fluoride salts, cleaning the cathode bottom and the like operations, the lids 6 are to be raised a little. To this end the drive (not shown) is put into action to turn the shaft 9 with the levers 10.

As one arm 14 (FIG. 3) of the hanger 13 is articulated along each lever 10, and the other arm 12 of the adjacent hanger 13 rests upon said lever with its loose end, the hanger 13 with the lids 6 will be raised when the levers 10 are moved up. When being raised each lid 6 slides along the inclined guideway 5 (FIG. 5) with its side having the shaped projection 24.

The lids 6 are raised for the height enough to introduce the actuating members of the mechanisms for piercing the electrolyte crust and charging alumina. As a result, the cell 2 (FIG. 2) gets slightly open, whereby the amount of gases escaping from under the covering into the shop's atmosphere is reduced and, therefore, the power consumed by the gas exhaust system is decreased accordingly. Moreover, labour conditions are much improved, since with the lids 6 opened but partly, the effect of gas and high temperature of convective and radiant heat emitted by the cell during operation, upon the attending personnel is considerably reduced.

Inasmuch as the lids 6 are located in front of the operator, the latter is in the safety zone and thus is out of danger of any injury.

In order to lower the lids 6, upon completing said work, one must merely engage the drive (not shown) to turn the shaft 9 (FIG. 2) with the levers 10 in the opposite direction. When being lowered the lids 6 slide with their shaped projections 24 along the inclined guideways 5, whereby the bottom edges of the lids 6 are immersed into alumina melt along the path approximating the perpendicular one so that the effect of the horizontal forces of resistance of alumina is completely avoided. Such a lowering of the lids 6 into alumina prevents also their bending and thus adds to their service life.

To effect visual control over the electrolysis process or discharge of liquid aluminium from the cell, it is quite enough to open manually one of the lids (FIG. 1). In this case the lid 6 is to be turned with respect to its top end face with the sleeve 11 (FIG. 3) fitted over the arm 12 of the double-arm hanger 13, and is tipped towards the level platform 8 until it assumes the position from which it cannot drop spontaneously.

Whenever it is necessary to replace one of the anodes 17 (FIG. 2) of the cell, one should turn the lid 6 arranged opposite to the anode by the technique discussed above, whereupon the lid 6 is turned further round the other arm 14 (FIG. 3) of the double-arm hanger 13 on said lid is mounted, and the latter is placed upon the adjacent lid 6 (FIG. 1). Then the metal plate 18 (FIG. 4) with the baffle 19 that is located opposite said anode 17 (FIG. 2), is shifted lengthwise in the articulated joints 20, with the result that the baffle 19 is displaced with respect to the inclined guideways 5 with which it has earlier been at the same level. Next the metal plate 18 is swivelled about the articulated joints 20 and placed upon the level platform 8. Thus, the space is opened for replacing the anode 17.

Upon replacing the anode 17 the recess 15 of the covering is closed. To this end, first the recess 15 (FIG. 4) is closed by turning the plate round the articulated joints 20, whereupon the plate 18 is shifted lengthwise until the baffle 19 engages the gap between the inclined guideways 5.

To close the individually opened lid 6 the latter is swivelled round the articulated joints in the order reversed as to that referred to for its opening.

In order to slightly open or to lower all the lids 6 arranged in a row along the side wall of the covering, one must appropriately turn the shaft 9 with the levers 10 by means of the reversible drive (not shown).

The covering under discussion is convenient and safe in attendance and, besides, it contributes to more economical running of the aluminium electrowinning process.

What we claim is:

1. An aluminium-producing electrolysis cell having vertical side walls and provided with holders for block-type preburnt anodes, comprising: a hood for gathering and extracting volatiles, located above said cell and having side walls whose edges are parallel to the cell side walls; slidable lids adjacent to one another and arranged inclinedly at the lower edges of said side walls of the hood; inclined guideways for each of said lids, made fast at the edges of said walls of the hood; drive shafts arranged along said electrolysis cell behind said anode-holders; levers secured on said drive shafts; double-arm right angle hangers, wherein one of the arms of each hanger is arranged along one of said levers pivotally round the longitudinal axis of said lever, while the other arm is articulated to the top end face of said lid and rests with its loose end upon the adjacent lever.

2. A cell as claimed in claim 1, wherein the portions of the side walls of said hood that are adjacent to its edges are made as level platforms, whereon said shafts with the levers are located.

3. A cell as claimed in claim 2, wherein provision is made in the side level portions of said hood for recesses for said anode-holder rods to pass through, said recesses being closed by metal plates with baffles adapted to close the space between the guideways and located at the same level therewith.

4. A cell as claimed in claim 3, wherein each of said metal plates is adapted to close said recess, with one of its sides connected to the level platform through an articulated joint having a gap in between its links for the plate to move lengthwise.

5. A cell as claimed in claim 1, wherein provision is made in each of said lids on its side facing the guideway for a shaped projection with bevels made in the direction of the lid movement along a preset steep path.

* * * * *